US005106320A

United States Patent [19]

Kinnear

[11] Patent Number: 5,106,320

[45] Date of Patent: Apr. 21, 1992

[54] POWER CABLE CONNECTOR

[76] Inventor: Joseph D. Kinnear, 4234 Linden Ave., Western Springs, Ill. 60558

[21] Appl. No.: 682,631

[22] Filed: Apr. 9, 1991

[51] Int. Cl.[5] ..... H01R 13/28; H01R 25/00

[52] U.S. Cl. ..... 439/295

[58] Field of Search ..... 439/290-292, 439/295, 287

[56] References Cited

U.S. PATENT DOCUMENTS

| | | | |
|---|---|---|---|
| 2,838,739 | 6/1958 | Winkler | 439/295 |
| 3,091,746 | 5/1963 | Winkler | 439/295 |
| 3,218,599 | 11/1965 | Winkler | 439/295 |
| 3,654,586 | 4/1972 | Winkler | 439/295 |
| 3,794,957 | 2/1974 | Winkler | 439/295 |
| 3,909,099 | 9/1975 | Winkler | 439/295 |
| 4,083,617 | 4/1978 | Wyatt | 439/295 |
| 4,335,931 | 6/1982 | Kinnear | 439/295 |

OTHER PUBLICATIONS

S Connector Brochure of Brad Harrison Co., dated earlier than Jan. 1, 1991.

SA Connector Catalog of Brad Harrison Co., dated before Apr. 9, 1991.

*Primary Examiner*—Paula A. Bradley

*Attorney, Agent, or Firm*—Peter D. Keefe

[57] ABSTRACT

A connector having an electrically insulative housing with at least one terminal receiving cavity extending longitudinally through the housing between the forward and rearward ends thereof. The forward end of the housing is structured to releasably mate with a similarly shaped housing of a second connector that is inverted relative to the first. The rearward end of the housing is structured so that each terminal receiving cavity longitudinally receives a terminal, the terminal having an attached electrical cable extending beyond the rearward end of the housing. A biasing spring in the form of a cantilever, biases the terminal transversely between the floor of the terminal receiving cavity and the terminal. A latch edge of the biasing spring interferingly engages the terminal so as to affix the terminal within the terminal receiving cavity. An access port through a wall of the housing permits a tool to be inserted therethrough to effect flexing of the biasing spring away from the terminal so that the terminal may be removed from the housing, and optionally, sliding the terminal out of the housing. It is preferred for the biasing spring to have tapered edge flanges which nestingly seat into reciprocably tapered recesses provided in the walls of the terminal receiving cavity. A metallic shroud within the terminal receiving cavity protects the housing from local heat damage and assists fixed seating of the biasing spring. A pair of tabs mounted to the housing prevents inadvertent positive-to-negative terminal interconnection.

31 Claims, 3 Drawing Sheets

POWER CABLE CONNECTOR

BACKGROUND OF THE INVENTION

1. Field of the Invention

The present invention relates to electrical connectors for use with battery power supplies, and in particular to such connectors structured for being mated in a selectively releasable manner. Still more particularly, the present invention relates to a genderless connector having terminal retention springs structured to selectively retain terminals in a fixed relationship within the connector, and further are easily adjusted so as to release the terminals from the connector. More particularly yet, the present invention relates to a connector in which the terminal retention springs are securely seated within the connector and are structured to provide excellent strength characteristics for biasing the terminals so as to provide reliable inter-terminal contact between mated connectors; a connector having a metallic shield for protecting the connector housing from damage due to electrically induced overheating and for fixedly seating the biasing spring; and a connector having tabs which prevent accidental improper interconnection between connectors.

2. Description of the Prior Art

Battery cable connectors are utilized to releasably interconnect a battery power supply with electrically powered equipment. A common application of this type is that of battery powered vehicles, such as forklifts and golf carts.

The connector is typically constructed of a plastic, electrically insulative material having a generally rectangularly shaped housing. The housing includes two terminal receiving cavities, placed side-by-side and longitudinally oriented within the housing. The forward end of the housing is genderless and structured to mate with an identical connector, while the rearward end of the housing is structured to receive, in each terminal cavity, a terminal with attached electrical cable. Each terminal is structured of an elongate shape with a contact portion at its forward end for electrically contacting its mate in the other connector that is mated therewith. In order to ensure proper electrical contact between mated terminals, a biasing spring is located within the housing of the connector which resiliently biases the terminal in an upwardly transverse direction. The biasing spring is generally in the form of a cantilever spring, and is structured to include an engagement structure that nominally abuts a ledge of the terminal which thereby affixes the terminal within the terminal cavity. Flexing the biasing spring away from the ledge in the terminal permits removal of the terminal from the terminal cavity, should the need ever arise.

An example of such a connector is recounted in detail in U.S. Pat. No. 4,335,931 to Joseph Kinnear, dated June 22, 1982, hereby incorporated by reference.

While such connectors are extremely useful and of low cost because of genderless design, they suffer from certain significant operational drawbacks. Firstly, it is difficult to cause the biasing spring to flex out of the way of the ledge of the terminal so that the terminal may be removed from the terminal cavity of the housing. As described in U.S. Pat. No. 4,335,931, a screwdriver or the like must be inserted into the front of the terminal cavity in order to press against the biasing spring to flex it. This is frequently difficult to accomplish, and can be impossible in the event two mated connectors are unable to be separated from one another, such as when they are fused due to overheating. When fused, the electrical cables must be cut, possibly requiring their replacement if they are no longer of sufficient length. Secondly, the biasing spring itself, as depicted in U.S. Pat. No. 4,335,931, suffers from degradation of strength due to having been lanced at its forward end and slotted at it base. Thirdly, the housing of the connector is constructed of a plastic, which while of excellent electrical insulatory property, is subject to structural deformation in the event an untoward incident arises causing electrical energy to be dissipated in the connector at a rate faster than can be comfortably distributed through and out of the connector housing. In an extreme case, the housing may deform to the point of rendering further service of the connector impossible due to melting. Such derogatory deformations may not be obvious from external inspection, in that the cantilever action of the biasing spring may have been compromised by its seat in the terminal cavity having melted. Fourthly, there is ever present the danger that a positive-negative terminal interconnection can be made, resulting in potential serious injury and extensive property damage as the battery shorts.

Accordingly, what is needed is a connector of the type generally disclosed in U.S. Pat. No. 4,335,931, now improved to provide effective and easy flexing of the biasing spring for purposes of removal of the terminal, provide an optimized strength of the biasing spring, protect the housing of the connector from much of the effects of overheating, and prevent accidental positive-negative terminal interconnection.

SUMMARY OF THE INVENTION

The present invention is a connector of the type generally disclosed in U.S. Pat. No. 4,335,931, now improved to provide effective and easy flexing of the biasing spring for purposes of terminal removal, provide an optimized strength of the biasing spring, protect the housing of the connector from much of the effects of overheating, and prevent accidental positive-negative terminal interconnection.

The connector according to the present invention is composed of an electrically insulative housing having at least one terminal receiving cavity extending longitudinally through the housing between the forward and rearward ends thereof. The forward end of the housing is genderless and structured to releasably mate with a similarly shaped housing of a second connector that is inverted relative to the first. The rearward end of the housing is structured so that each terminal receiving cavity longitudinally receives a terminal, the terminal having an attached electrical cable extending beyond the rearward end of the housing. The terminal includes a contact portion at the forward end thereof, and which is fixed within the housing substantially adjacent the front end of the housing. A biasing spring in the form of a cantilever, includes at one end a base that is rigidly secured to the housing, and includes further a biasing portion extending from the base. The biasing portion biases the terminal transversely between the floor of the terminal receiving cavity and the terminal. The biasing portion includes a latching structure for interferingly engaging the terminal so as to affix the terminal within the terminal receiving cavity.

According to one aspect of the present invention, there is provided an access port through a wall of the housing which permits a tool to be inserted therethrough which thereupon effects to flex the biasing portion of the biasing spring away from the terminal so that the terminal may be removed from the terminal receiving cavity. It is preferred for the terminal and the biasing portion of the biasing spring to be dimpled so as to facilitate insertion of the tool. Further, the access port of each terminal receiving cavity may be located either at the front or at the side of the housing, and, advantageously, when positioned at the front of the housing, an abutment is provided in the terminal for the tool to push the terminal out of the terminal receiving cavity.

According to a second aspect of the present invention, there is provided a biasing spring having tapered edge flanges which nestingly seat into reciprocably tapered recesses provided in the walls of the terminal receiving cavity. It is preferred for the biasing spring to be substantially rectangular in shape, having no cutouts, slots, lancing, or other cuts which result in loss of strength.

According to a third aspect of the present invention, there is provided a metallic shroud within the terminal receiving cavity, located adjacent the base of the biasing spring. The metallic shroud serves to protect the housing geometry from local heat damage in the event an untoward electrical situation occurs, and further assures fixed, rigid seating of the biasing spring within the housing.

According to a fourth aspect of the present invention, there is provided a pair of tabs mounted to the housing which prevents the positive terminal of one connector from being unintentionally connected with the negative terminal of another connector, yet permits easy connection of one terminal to another when terminals are being correctly interconnected.

Accordingly, it is an object of the present invention to provide a connector in which the biasing spring is easily and effectively flexed from interfering with removal of the terminal.

It is a further object of the present invention to provide a connector having a biasing spring structured to optimize strength.

It is another object of the present invention to provide a connector in which the housing is substantially protected from deformation due to overheating, especially at the intermediate wall and the seat of the biasing spring, and further in respect thereto, in which the biasing spring is fixedly retained with respect to the housing.

It is still a further object of the present invention to provide a connector in which it is not possible to unintentionally connect a positive terminal to a negative terminal.

These, and additional objects, advantages, features and benefits of the present invention will become apparent from the following specification.

DETAILED DESCRIPTION OF THE PREFERRED EMBODIMENT

Figure 1:
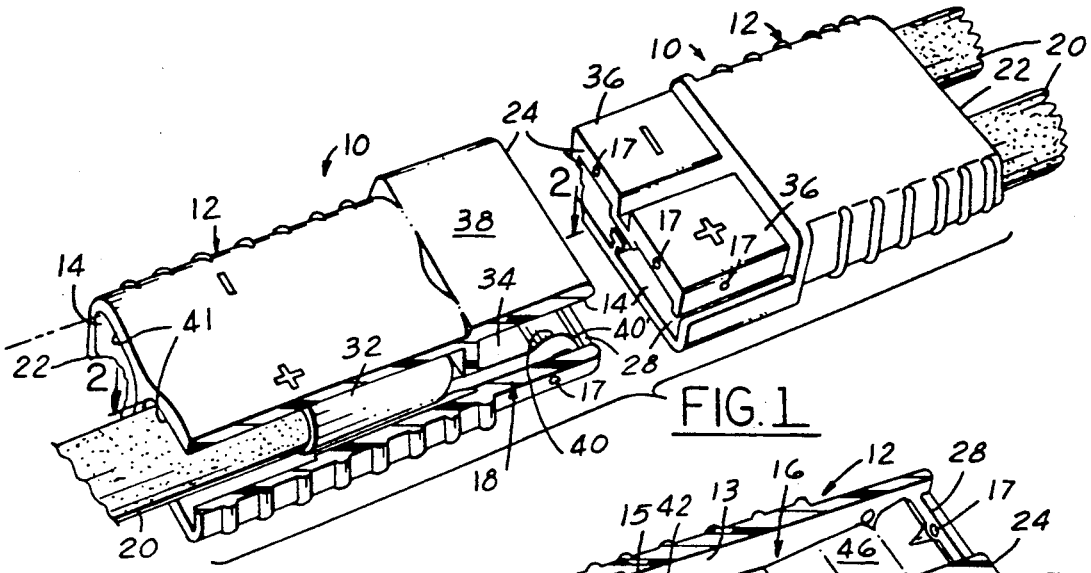
FIG. 1 is a perspective view of connectors according to the present invention about to be mated, particularly showing access ports at both the side and front of the housing.

Referring now to the Drawing, FIG. 1 shows a pair of connectors 10, each identical, with one inverted relative to the other ready for mating.

Each connector 10 includes a housing 12 constructed of a durable insulatory material, such as a high impact resistant polycarbonate. The housing 12 has preferably a pair of generally mutually parallel, laterally spaced apart, substantially identical, terminal receiving cavities 14. Each terminal receiving cavity has connected therewithin a biasing spring 16 and has received therein an electrical terminal 18 which, in turn, has connected thereto an electrical cable 20. When mated, the connectors establish electrical connection between respectively paired electrical terminals. In many respects the connectors of the present invention share structural and operational features of connectors disclosed in U.S. Pat. No. 4,335,931.

The housing 12 of each connector 10 is preferred to be of unitary construction and is provided with a rearward cable receiving portion 22, and with a forward coupling portion 24 that is structured to mate with the forward coupling portion of a second identical connector which is inverted relative to the first. Each terminal receiving cavity 14 extends longitudinally through the housing 12, and is subdivided into a rearward cable receiving segment 26 and a forward contact receiving segment 28 by an intermediate wall 30.

Figure 3:
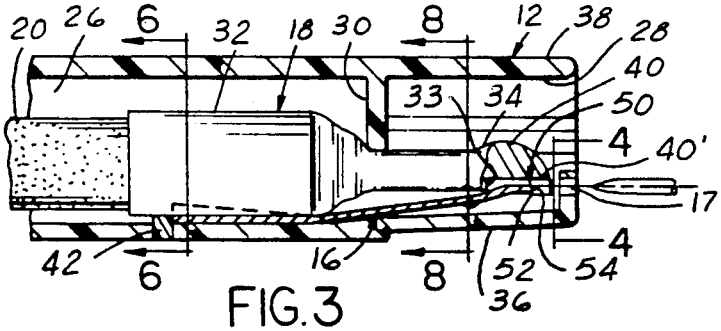
FIG. 3 is a partly sectional side view of a connector according to the present invention, seen along lines 3—3 in FIG. 2.

The electrical terminal 18 is constructed of a relatively strong electrically conductive material, such as copper, formed, for example, by an extrusion process. Each electrical terminal includes a rearward end having an electrical cable attachment structure 32, and a forward end including an electrical contact portion 34 of a generally blade-like configuration. When the electrical terminal 18 is inserted into the terminal receiving cavity 14 through the rearward cable receiving segment 26, the electrical contact portion 34 extends beyond the intermediate wall 30 into the forward contact receiving segment 28. The intermediate wall 30 serves as a forward stop for the electrical terminal 18, as illustrated in FIG. 3.

The forward coupling portion 24 of the housing 12 includes a tray structure 36 and a cover structure 38 associated with each terminal receiving cavity 14, the forward contact receiving segment 28 being defined thereby.

The electrical contact portion 34 of the electrical terminal 18 includes, preferably, a rounded contact surface 40 adjacent its forward end 40'. When two connectors 10 are mated at the forward coupling portions 24, with one being inverted with respect to the other, the contact surfaces 40 of respectively contacting electrical terminals 18 overlappingly wipe one another, providing good electrical contact therebetween. In order to ensure that the aforesaid wiping action proceeds so as to provide excellent electrical contact, the electrical terminals are biased toward one another by action of respective biasing springs 16.

Figure 7:
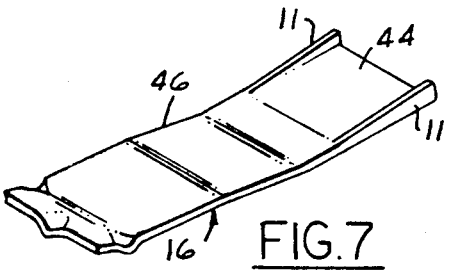
FIG. 7 is a perspective view of the biasing spring according to the present invention.
Figure 2:
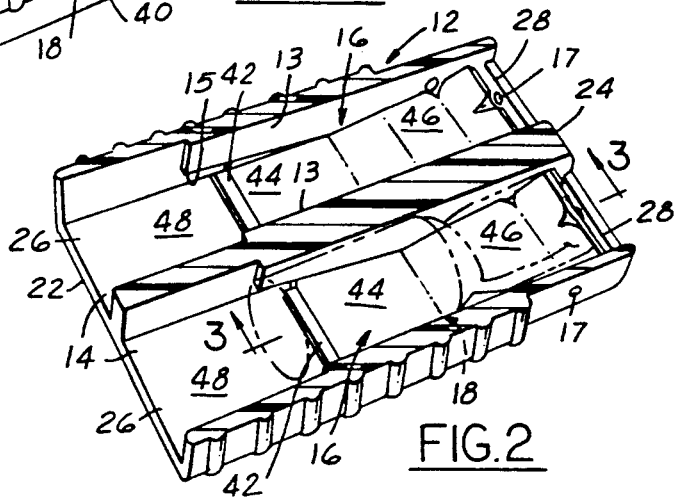
FIG. 2 is a partly sectional perspective view of a connector according to the present invention, seen along lines 2—2 in FIG. 1.

The preferred structure of the biasing spring 16 is shown in FIG. 7. The biasing spring 16 is constructed of a resilient material, such as spring steel, and includes a base portion 44 and a biasing portion 46. The base portion 44 is attached to the housing 12 adjacent the floor 48 of the cable receiving portion 26 of the terminal receiving cavity 14. It is preferred in this regard to provide tapered flanges 11 at each side of the base portion 44. The sidewalls 13 of the cable receiving segment 26 of the terminal receiving cavity 14 are provided with tapered indentations 15, each dimensioned to precisely receive a respective one of the flanges 11, thereby seating the base portion 44 with respect to the housing 12. An insert 42 is provided through the housing in order to serve as a stop to hold the base portion 44 in fixed relation to the tapered indentations 15. The biasing spring 16 is structured and shaped in order to cantilever forwardly into the cable receiving segment 26 so as to resiliently bias, via the biasing portion 46, the electrical terminal 18 into good electrical contact with its respective mate, as described hereinabove. It will be understood that the structure shown in FIG. 7 is an improvement over prior structures, such as that depicted in U.S. Pat. No. 4,335,931, in that it provides for maximal strength of the biasing spring 16, in that there are no cut-outs, slots, lancing, or other cuts therein which may in one way or another compromise strength, and further in that a fixed, inflexible seating for the base portion of the biasing spring 16.

In order that the electrical terminal 18 be seated within the terminal receiving cavity 14 so that good electrical contact is effected when connectors 12 are mated, as described hereinabove, a latching structure 50 is associated with the biasing portion 46 of the biasing spring 16 and the terminal 18. In this regard, the electrical terminal 18 is provided, on a side located oppositely with respect to the electrical contact portion 34, with a rearwardly facing ledge 52 located generally proximate to the forward end 40'. Further in this regard, the the biasing portion 46 of the biasing spring 16 includes a forwardly disposed latch edge 54. In operation, as the electrical terminal is longitudinally inserted into the terminal receiving cavity 14 through the rearward cable receiving segment 26, the latch edge 54 is biased downwardly by contact with the electrical terminal toward the floor 48. Upon full insertion of the electrical terminal 18 into the terminal receiving cavity 14, the latch edge 54 resiliently engages upwardly into interfering engagement with the ledge 52 of the electrical terminal, thereby, in combination with operation of the intermediate wall 30, preventing the electrical terminal from longitudinally sliding within the terminal receiving cavity.

Figure 4:
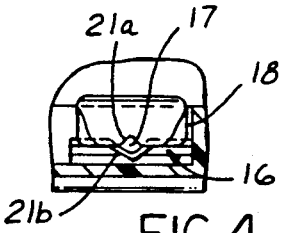
FIG. 4 is a partly sectional frontal view of a connector according to the present invention, seen along lines 4—4 in FIG. 3.
Figure 5:
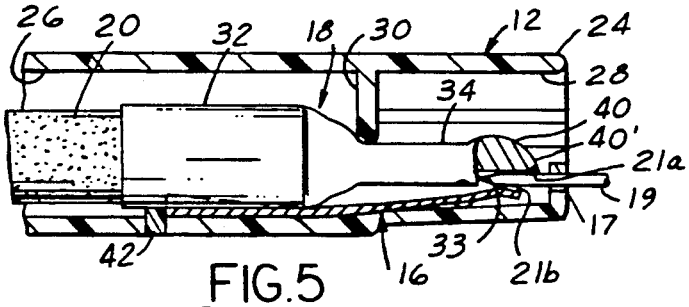
FIG. 5 is a partly sectional side view of a connector shown in FIG. 3, now depicting an insertion tool inserted into the access port so as to effect flexing of the biasing spring away from the terminal.
Figure 6:
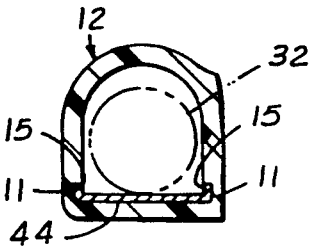
FIG. 6 is a sectional view of a connector according to the present invention, seen along lines 6—6 in FIG. 3.
Figure 8:
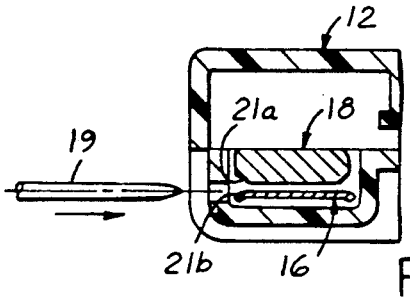
FIG. 8 is a sectional frontal view of a connector according to the present invention, seen along lines 8—8 in FIG. 3.
Figure 9:
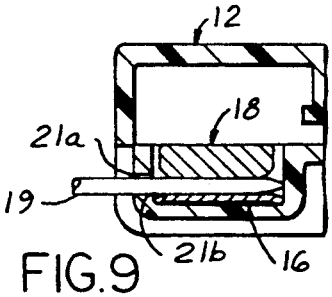
FIG. 9 is a sectional frontal view of a connector shown in FIG. 8, now depicting an insertion tool inserted into the access port so as to effect flexing of the biasing spring away from the terminal.

In order to facilitate removal of the electrical terminal 18 from the terminal receiving cavity 14, it is necessary for the biasing portion 46 of the biasing spring 16 to be flexed so that the latch edge 54 can be moved out of interfering engagement with the ledge 52 in the electrical terminal 18. This is facilitously accomplished by providing an access port 17 at each side 19 or at the forward end 21 of the housing at the forward coupling portion 12. FIG. 1 depicts connectors having access ports 17 at both of these locations for each terminal receiving cavity 14; connectors may have but one access port at either location, as desired. The access ports 17 are preferred to be sized so that a small tool 19, on the order, preferably, of the diameter of a 10 penny nail, may be inserted through the housing 12 into the subject terminal receiving cavity 14. It is further preferred that the electrical terminal 18 and the biasing spring 16 be dimpled at the location whereat the tool would contact mutually therewith, as exposited in FIGS. 4 and 8.

Advantageously, when the access ports 17 are located at the forward end 21 of the housing 12, a blind bore or tunnel with abutment 33 may be provided in the terminal 18. The abutment is located so that after the tool has caused the latch edge 54 to have disengaged the ledge 52, the tool will have abutted the abutment. Thereupon, further pushing on the tool 19 will result in the terminal 18 being slid in the terminal receiving cavity 14 in a direction away from the forward end of the housing, thereby assisting removal of the terminal.

As can be discerned by reference to FIGS. 3, 5, 8 and 9, the dimples **21*a*, 21*b* provide starting entry for the tip of the tool to allow the tool to insert between the biasing spring and the electrical terminal, the diameter of the tool 19 causing the biasing spring to flex sufficiently for the latch edge 54 to disengage with respect to the ledge 52, thereby permitting the electrical terminal 18 to be slid out of the terminal receiving cavity 14**.

A serious problem that can arise in operation of the connectors 10 is structural degredation of the housing 12 due to overheating. For example, overheating can be caused by poor terminal contact resulting in resistive heating which is transmitted to the rearward cable receiving segment 26 of the terminal receiving cavity 14 via conduction along the biasing spring 16 and the electrical terminal 18. This may be minimized by distributing this undesirable heat so that it is not sufficiently concentrated as to cause deformation of the housing material. Very sensitive parts of the connector with regard to deformation due to heat effects are the seating of the base portion 44 of the biasing spring 16 and the intermediate wall 30.

Figure 11:
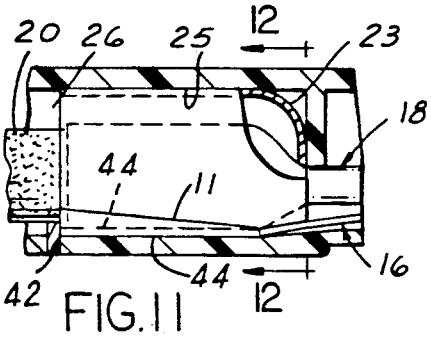
FIG. 11 is a partly sectional side view of a connector according to the present invention, seen along lines 11—11 in FIG. 10.
Figure 10:
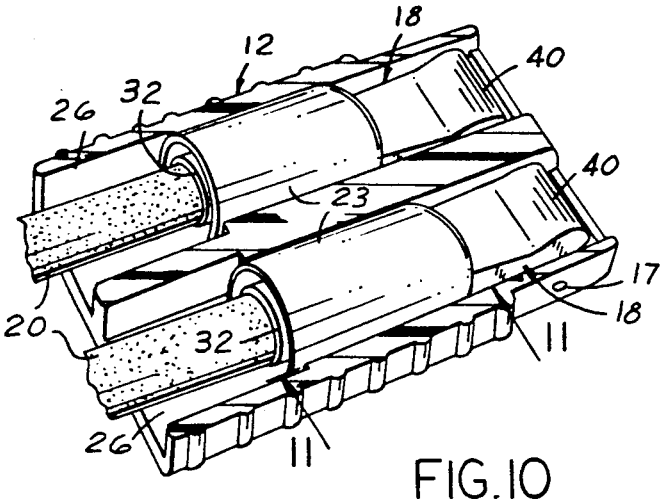
FIG. 10 is a perspective cut-away view of a connector according to the present invention, particularly showing shrouds which form a part of the present invention.
Figure 12:
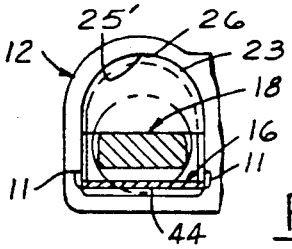
FIG. 12 is a partly sectional frontal view of a connector according to the present invention, seen along lines 12—12 in FIG. 11.
Figure 13:
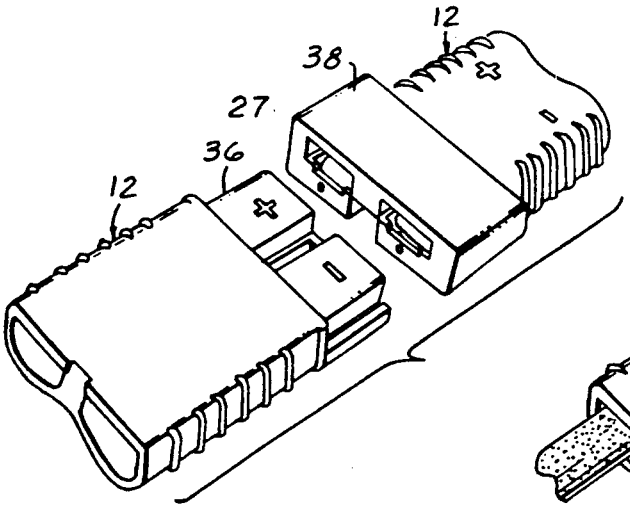
FIG. 13 is a perspective view of a pair of connectors according to the present invention about to be mated, wherein one of the connectors is equipped with tabs to prevent improper interconnection.
Figure 14:
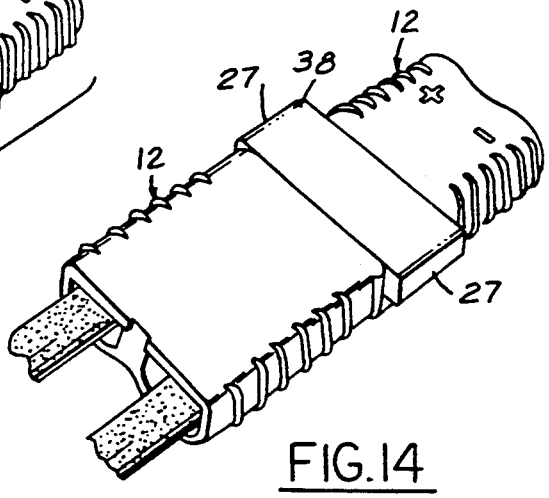
FIG. 14 is a perspective view of the connectors shown in FIG. 13, now depicting them mated to each other.

Accordingly, a shroud 23, preferably constructed of metallic material such as steel, is provided which conforms generally to the wall shape of the rearward cable receiving segment 26 of the terminal receiving cavity 14 in the area generally adjacent the base portion 44 of the biasing spring 16. As can be discerned by reference now being made to FIGS. 11, 12 and 13, the shroud 23 is shaped so that at its forward end it abuts the intermediate wall 30 and its upper end it abuts a wall 25 of the rearward cable receiving segment, the apex 25' of the wall 25 being oppositely situated relative to the floor 48. Further, the shroud is structured so as to have an open lower end which seats upon the base portion 44 of the biasing spring 16 between the flanges 11. The insert 42 now serves to retain both the base portion 44 of the biasing spring 16 and the shroud 23 in fixed position within the rearward cable receiving portion 22 of the terminal receiving cavity 14. Should the connector ever be subjected to an untoward amount of heating, the shroud 23 will thereupon serve to retain geometric integrity of the terminal receiving cavity 14 so as to minimize heat damage to the housing 12. At the same time, the shroud will serve to fixedly retain the base portion 44 of the biasing spring 16 against the floor 48, since the shroud extends between the wall 25 and the base portion 44. Accordingly, the strength of the shroud as determined by its composition and wall thickness is such as to achieve these advantageous results.

There can arise situations in which a user could accidentally connect the connectors, as depicted in FIGS. 1 through 12, together in a manner inconsistent with proper usage. For instance a user may have to connect connectors together in a tight, elongate compartment in which the user can only feel his/her way, rather than see what he/she is doing. In such an instance, it might be possible for the user to accidentally make an improper connection, as for instance a negative terminal to a positive terminal, thereby resulting in potentially grave injury and disastrous damage due to shorting of the battery. In order to prevent this from ever occurring, it is preferred to place tabs 27 on each side of the cover structure 38 of the housing 12 of, at minimum, the connector which is connected to the power source (i.e., the battery).

Figure 15:
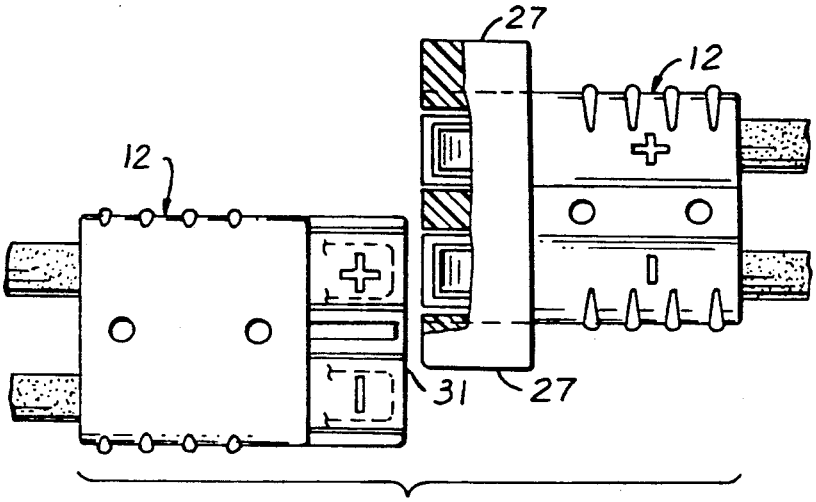
FIG. 15 is a partly sectional plan view of the connectors shown in FIG. 13 in a mutual orientation in which the tabs prevent mating in the mutual orientation as shown.
Figure 17:
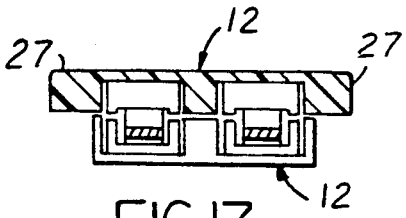
FIG. 17 is a partly sectional frontal view of a connector according to the present invention, seen along lines 17—17 in FIG. 16.
Figure 16:
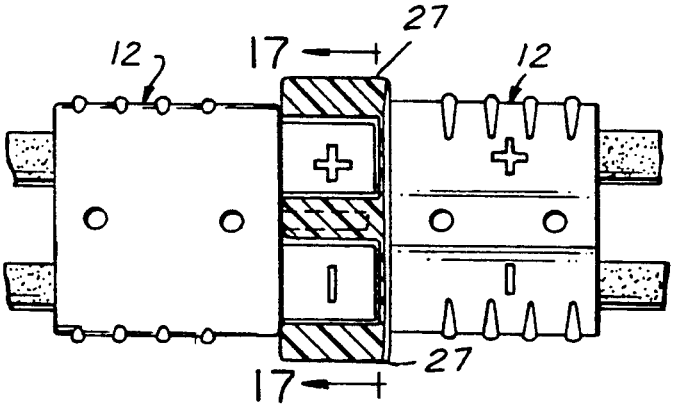
FIG. 16 is a partly sectional plan view of the connectors shown in FIG. 13, depicting them mated to one another.
Figure 18:
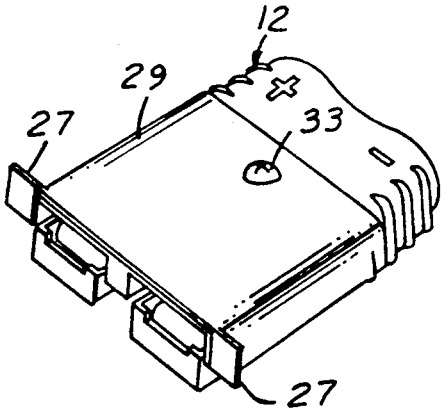
FIG. 18 is a perspective view of a connector according to the present invention, showing an alternative tab structure.

As can be understood by reference now being directed to FIG. 15, the tabs 27 interferingly engage the housing at location 31 so as prevent the user from accidentally improperly mating connectors. But as shown in FIGS. 16 and 17, the tabs do not in any way interfere with a proper mating of the connectors. The tabs 27 may be integrally formed as part of the housing or added thereto by a process well known in the art such as by adhesives or sonic welding. Alternatively, especially in situations of retrofitting to existing conventional connectors, the tabs 27 may be structured as an overlay 29, formed preferably from a thin metallic sheet, which attaches to the housing in a manner well known in the art, such as by a screw or bolt 33.

To those skilled in art to which this invention appertains, the above described preferred embodiment may be subject to change or modification. For instance, any of the improvements of U.S. Pat. No. 4,335,931 described hereinabove may be utilized in a connector either independently or collectively in any combination. Such change of modification can be carried out without departing from the scope of the invention, which is intended to be limited only the scope of the appended claims.

What is claimed is:

1. An electrical connector, comprising:

a housing formed of electrically insulative material, said housing having a forward end and a rearward end;

at least one terminal receiving cavity extending through said housing longitudinally between said forward end and said rearward end thereof; said electrical connector further comprising with respect to each terminal receiving cavity:

an electrical terminal longitudinally insertable into said terminal receiving cavity from said rearward end of said housing, said electrical terminal having a forward end and a rearward end, said forward end of said electrical terminal being provided with a contact portion located on a first side thereof, said foward end of each said electrical terminal being provided with ledge means located on a second side thereof opposite said first side, said rearward end of each said electrical terminal being provided with electrical cable connection means for connecting an electrical cable thereto;

an intermediate wall connected with said housing and located within said terminal receiving cavity;

a biasing spring located in said terminal receiving cavity, said biasing spring having a base portion and a biasing portion, said base portion being fixedly mounted with respect to said housing, said biasing portion extending longitudinally toward said forward end of said housing, said biasing portion having a latch edge which engages said ledge means of said electrical terminal when said electrical terminal is inserted fully into said terminal receiving cavity so that a portion of said electrical terminal abuts said intermediate wall to thereby fixedly locate said electrical terminal with said terminal receiving cavity; and at least one access port extending through said housing proximate said forward end thereof so that a tool may be inserted therethrough to thereby cause said biasing portion of said biasing spring to flex resulting in said latch edge of said biasing spring to disengage from said ledge of said electrical terminal to thereby permit said electrical terminal to be withdrawn from said terminal receiving cavity;

wherein the forward end of one said connector may be mated to the forward end of a second said connector that is inverted relative to the first connector, and said electrical terminal of each said terminal receiving cavity of the first connector will be thereby electrically connected with a respective electrical terminal of the second connector.

2. The connector of claim 1, further comprising a dimple in each of said electrical terminal and said biasing spring, each said dimple being mutually adjacent and located next to each said access port so that the tool may pass through said access port, receivably enter into said dimples, and then pass between said electrical terminal and said biasing spring.

3. The connector of claim 1, wherein said connector has two terminal receiving cavities, said connector further comprising tab means located on said housing at said front end thereof for interferingly preventing engagement with a second connector when only one of said two terminal receiving cavities thereof is being mutually matingly engaged.

4. The connector of claim 3, further comprising tapered flanges on each side of said base portion of said biasing spring, said tapered flanges tapering perpendicularly with respect to said base portion beginning at a location substantially adjacent said biasing portion; said terminal receiving cavity further being provided with tapered recesses structured for receiving said tapered flanges as said biasing spring is inserted into said terminal receiving cavity from said rear end thereof toward said forward end thereof so as to thereby fixedly seat said base portion of said biasing spring within said terminal receiving cavity.

5. The connector of claim 1, further comprising a shroud located in said terminal receiving cavity, said shroud being constructed of a strong metallic material, said shroud being shaped to generally conform with said terminal receiving cavity so as to be in contact with a wall of said terminal receiving cavity that is located directly opposite said base portion of said biasing spring, said shroud being in contact with said base portion of said biasing spring.

6. The connector of claim 5, wherein said connector has two terminal receiving cavities, said connector further comprising tab means located on said housing at said front end thereof for interferingly preventing engagement with a second connector when only one of said two terminal receiving cavities thereof is being mutually matingly engaged.

7. The connector of claim 6, further comprising tapered flanges on each side of said base portion of said biasing spring. said tapered flanges tapered perpendicularly with respect to said base portion beginning at a location substantially adjacent said biasing portion; said terminal receiving cavity further being provided with tapered recesses structured for receiving said tapered flanges as said biasing spring is inserted into said terminal receiving cavity from said rear end thereof toward said forward end thereof so as to thereby fixedly seat said base portion of said biasing spring within said terminal receiving cavity.

8. The connector of claim 1, further comprising tapered flanges on each side of said base portion of said biasing spring, said tapered flanges tapered perpendicularly with respect to said base portion beginning at a location substantially adjacent said biasing portion; said terminal receiving cavity further being provided with tapered recesses structured for receiving said tapered flanges as said biasing spring is inserted into said terminal receiving cavity from said rear end thereof toward said forward end thereof so as to thereby fixedly seat said base portion of said biasing spring within said terminal receiving cavity.

9. The connector of claim 8, wherein said biasing spring has a substantially rectangular shape characterized by four substantially straight edges.

10. The connector of claim 8, further comprising a shroud located in said terminal receiving cavity, said shroud being constructed of a strong metallic material, said shroud being shaped to generally conform with said terminal receiving cavity so as to be in contact with a wall of said terminal reveiving cavity that is located directly opposite said base portion of said biasing spring, said shroud being in contact with said base portion of said biasing spring between said flanges.

11. The connector of claim 10, further comprising a dimple in each of said electrical terminal and said biasing spring, each said dimple being mutually adjacent and located next to each said access port so that the tool may pass through said access port, receivably enter into said dimples, and then pass between said electrical terminal and said biasing spring.

12. The connector of claim 11, wherein said connector has two terminal receiving cavities, said connector further comprising tab means locating on said housing at said front end thereof for interferingly preventing engagement with a second connector when only one of said two terminal receiving cavities thereof is being mutually matingly engaged.

13. The connector of claim 1, further comprising abutment means located on said electrical terminal for providing a location the tool can push against to slide said electrical terminal within said terminal receiving cavity after the tool has caused said latch edge to disengage from said ledge.

14. The connector of claim 13, further comprising a dimple in each of said electrical terminal and said biasing spring, each said dimple being mutually adjacent and located next to each said access port so that the tool may pass through said access port, receivably enter into said dimples, and then pass between said electrical terminal and said biasing spring.

15. The connector of claim 13, wherein said connector has two terminal receiving cavities, said connector further comprising tab means located on said housing at said front end thereof for interferingly preventing engagement with a second connector when only one of said two terminal receiving cavities thereof is being mutually matingly engaged.

16. The connector of claim 15, further comprising tapered flanges on each side of said base portion of said biasing spring, said tapered flanges tapering perpendicularly with respect to said base portion beginning at a location substantially adjacent said biasing portion; said terminal receiving cavity further being provided with tapered recesses structured for receiving said tapered flanges as said biasing spring is inserted into said terminal receiving cavity from said rear end thereof toward said forward end thereof so as to thereby fixedly seat said base portion of said biasing spring within said terminal receiving cavity.

17. The connector of claim 13, further comprising a shroud located in said terminal receiving cavity, said shroud being constructed of a strong metallic material, said shroud being shaped to generally conform with said terminal receiving cavity so as to be contact with a wall of said terminal receiving cavity that is located directly opposite said base portion of said biasing spring, said shroud being in contact with said base portion of said biasing spring.

18. The connector of claim 17, wherein said connector has two terminal receiving cavities, said connector further comprising tab means located on said housing at said front end thereof for interferingly preventing engagement with a second connector when only one of said two terminal receiving cavities thereof is being mutually matingly engaged.

19. The connector of claim 18, further comprising tapered flanges on each side of said base portion of said biasing spring, said tapered flanges tapering perpendicularly with respect to said base portion beginning at a location substantially adjacent said biasing portion; said terminal receiving cavity further being provided with tapered recesses structured for receiving said tapered flanges as said biasing spring is inserted into said terminal receiving cavity from said rear end thereof toward said forward end thereof so as to thereby fixedly seat said base portion of said biasing spring within said terminal receiving cavity.

20. The connector of claim 13, further comprising tapered flanges on each side of said base portion of said biasing spring, said tapered flanges tapering perpendicularly with respect to said base portion beginning at a location substantially adjacent said biasing portion; said terminal receiving cavity further being provided with tapered recesses structured for receiving said tapered flanges as said biasing spring is inserted into said terminal receiving cavity from said rear end thereof toward said forward end thereof so as to thereby fixedly seat said base portion of said biasing spring within said terminal receiving cavity.

21. The connector of claim 20, wherein said biasing spring has a substantially rectangular shape characterized by four substantially straight edges.

22. The connector of claim 20, further comprising a shroud located in said terminal receiving cavity, said shroud being constructed of a strong metallic material, said shroud being shaped to generally conform with said terminal receiving cavity so as to be in contact with a wall of said terminal receiving cavity that is located directly opposite said base portion of said biasing spring, said shroud being in contact with said base portion of said biasing spring between said flanges.

23. The connector of claim 22, further comprising a dimple in each of said electrical terminal and said biasing spring, each said dimple being mutually adjacent and located next to each said access port so that the tool may pass through said access port, receivably enter into said dimples, and then pass between said electrical terminal and said biasing spring.

24. The connector of claim 23, wherein said connector has two terminal receiving cavities, said connector further comprising tab means located on said housing at said front end thereof for interferingly preventing engagement with a second connector when only one of said two terminal receiving cavities thereof is being mutually matingly engaged.

25. An electrical connector, comprising:

a housing formed of electrically insulative material, said housing having a forward end and a rearward end;

at least one terminal receiving cavity extending through said housing longitudinally between said forward end and said rearward end thereof; said electrical connector further comprising with respect to each terminal receiving cavity:

an electrical terminal longitudinally insertable into said terminal receiving cavity from said rearward end of said housing, said electrical terminal having a forward end and a rearward end, said forward end of said electrical terminal being provided with a contact portion located on a first side thereof, said forward end of each said electrical terminal being provided with ledge means located on a second side thereof opposite said first side, said rearward end of each said electrical terminal being provided with electrical cable connection means for connecting an electrical cable thereto:

an intermediate wall connected with said housing and located within said terminal receiving cavity; and a biasing spring located in said terminal receiving cavity, said biasing spring having a base portion and a biasing portion, said base portion being fixedly mounted with respect to said housing, said biasing portion extending longitudinally toward said forward end of said housing, said biasing portion having a latch edge which engages said ledge means of said electrical terminal when said electrical terminal is inserted fully into said respective terminal receiving cavity so that a portion of said electrical terminal abuts said intermediate wall to thereby fixedly locate said electrical terminal within said terminal receiving cavity, said base portion further having tapered flanges on each side of said base portion of said biasing spring, said tapered flanges tapering perpendicularly with respect to said base portion beginning at a location substantially adjacent said biasing portion; each said terminal receiving cavity further being provided with tapered recesses structured for receiving said tapered flanges as said biasing spring is inserted into said terminal receiving cavity from said rear end thereof toward said forward end thereof so as to thereby fixedly seat said base portion of said biasing spring therewithin;

wherein the forward end of one said connector may be mated to the forward end of a second said connector that is inverted relative to the first connector, and said electrical terminal of each said terminal receiving cavity of the first connector will be thereby electrically connected with a respective electrical terminal of the second connector.

26. The connector of claim 25, wherein said connector has two terminal receiving cavities, said connector further comprising tab means located on said housing at said front end thereof for interferingly preventing engagement with a second connector when only one of said two terminal receiving cavites thereof is being mutually matingly engaged.

27. An electrical connector, comprising:

a housing formed of electrically insulative material, said housing having a forward end and a rearward end;

at least one terminal receiving cavity extending through said housing longitudinally between said forward end and said rearward end thereof; said electrical connector further comprising with respect to each terminal receiving cavity:

an electrical terminal longitudinally insertable into said terminal receiving cavity from said rearward end of said housing, each said electrical terminal having a forward end and a rearward end, said forward end of said electrical terminal being provided with a contact portion located on a first side thereof, said forward end of each said electrical terminal being provided with ledge means located on a second side thereof opposite said first side, said rearward end of each said electrical terminal being provided with electrical cable connection means for connecting an electrical cable thereto:

an intermediate wall connected with said housing and located within said terminal receiving cavity;

a biasing spring located in said terminal receiving cavity, said biasing spring having a base portion and a portion, said base portion being fixedly mounted with respect to said housing, said biasing portion extending longitudinally toward said forward end of said housing, biasing portion having a latch edge which engages said ledge means of said electrical terminal when said electrical terminal is inserted fully into said terminal receiving cavity so that a portion of said electrical terminal abuts said intermediate wall to thereby fixedly locate said electrical terminal receiving cavity; and a shroud constructed of a strong metallic material located in said terminal cavity, said shroud being shaped to generally conform with said terminal receiving cavity so as to be in contact with a wall of said terminal receiving cavity that is located directly opposite said base portion of said biasing spring, said shroud being in contact with said base portion of said biasing spring;

wherein the forward end of one said connector may be mated to the forward end of a second said connector that is inverted relative to the first connector, and said electrical terminal of each said terminal receiving cavity of the first connector will be thereby electrically connected with a respective electrical terminal of the second connector.

28. The connector of claim 27, wherein said connector has two terminal receiving cavities, said connector further comprising tab means located on said housing at said front end thereof for interferingly preventing engagement with a second connector when only one of said two terminal receiving cavities thereof is being mutually matingly engaged.

29. The connector of claim 27, further comprising tapered flanges on each side of said base portion of said biasing spring, said tapered flanges tapering perpendicularly with respect to said base portion beginning at a location substantially adjacent said biasing portion; said terminal receiving cavity further being provided with tapered recesses structured for receiving said tapered flanges as said biasing spring is inserted into said terminal receiving cavity from said rear end thereof toward said forward end thereof so as to thereby fixedly seat said base portion of said biasing spring within said terminal receiving cavity.

30. The connector of claim 29, wherein said connector has two terminal receiving cavites, said connector further comprising tab means located on said housing at said front end thereof for interferingly preventing engagement with a second connector when only one of said two terminal receiving cavities thereof is being mutually matingly engaged.

31. An electrical connector, comprising:

a housing formed of electrically insulative material, said housing having a forward end and a rearward end;

two terminal receiving cavities each extending through said housing longitudinally between said forward end and said rearward end thereof;

tab means located on said housing at said front end thereof for interferingly preventing engagement with respect to a second connector when only one of said two terminal receiving cavities thereof is being mutually matingly engaged; said electrical connector further comprising with respect to each terminal receiving cavity:

an electrical terminal longitudinally insertable into said terminal receiving cavity from said rearward end of said housing, said electrical terminal having a forward end and a reaward end, said forward end of said electrical terminal being provided with a contact portion located on a first side thereof, said forward end of each said electrical terminal being provided with ledge means located on a second side thereof opposite said first side, said rearward end of each said electrical terminal being provided with electrical cable conncetion means for connecting an electrical cable thereto;

an intermediate wall connected with said housing and located within said terminal receiving cavity; and a biasing spring located in said terminal receiving cavity, said biasing spring having a base portion and a biasing portion, said base portion being fixedly mounted with respect to said housing, said biasing portion extending longitudinally toward said forward end of said housing, said biasing portion having a latch edge which engages said ledge means of said electrical terminal when said electrical terminal is inserted fully into said terminal receiving cavity so that a portion of said electrical terminal abuts said intermediate wall to thereby fixedly locate said electrical terminal within said terminal receiving cavity;

wherein the forward end of one said connector may be mated to the forward end of a second said connector that is inverted relative to the first connector, and said electrical terminal of each said terminal receiving cavity of the first connector will be thereby electrically connected with a respective electrical terminal of the second connector.

* * * * *